US005753843A

United States Patent [19]

Fay

[11] Patent Number: 5,753,843

[45] Date of Patent: May 19, 1998

[54] SYSTEM AND PROCESS FOR COMPOSING MUSICAL SECTIONS

[75] Inventor: C. Todor Fay, Atlanta, Ga.

[73] Assignee: Microsoft Corporation, Redmond, Wash.

[21] Appl. No.: 384,668

[22] Filed: Feb. 6, 1995

[51] Int. Cl.[6] ..... A63H 5/00; G04B 13/00; G10H 7/00

[52] U.S. Cl. ..... 84/609; 84/613; 84/634; 84/637; 84/649

[58] Field of Search ..... 84/600, 609, 610, 84/613, 634, 637, 649

[56] References Cited

U.S. PATENT DOCUMENTS

| | | | |
|---|---|---|---|
| 4,526,078 | 7/1985 | Chadabe . | |
| 4,716,804 | 1/1988 | Chadabe . | |
| 5,052,267 | 10/1991 | Ino . | |
| 5,164,531 | 11/1992 | Imaizumi et al. . | |
| 5,179,241 | 1/1993 | Okuda et al. . | |
| 5,218,153 | 6/1993 | Minamitaka . | |
| 5,278,348 | 1/1994 | Eitaki et al. . | |
| 5,281,754 | 1/1994 | Farrett et al. | 84/609 |
| 5,286,908 | 2/1994 | Jungleib | 84/609 X |
| 5,315,057 | 5/1994 | Land et al. . | |
| 5,355,762 | 10/1994 | Tabata | 84/609 |
| 5,455,378 | 10/1995 | Paulson et al. | 84/601 |
| 5,496,962 | 3/1996 | Meier et al. | 84/601 |

*Primary Examiner*—William M. Shoop, Jr.
*Assistant Examiner*—Jeffrey W. Donels
*Attorney, Agent, or Firm*—Jones & Askew, LLP

[57] ABSTRACT

A system and process for comprising a musical section in response to a user's interaction with a multimedia presentation is disclosed. The system includes a composition engine, performance engine, and arbitrator. The arbitrator provides an interface with an application program running a multimedia presentation. The arbitrator receives parameters from the application program indicative of a user's interaction and the type of music the application program requests in response to the interaction. The parameters are passed to the composition engine which composes a musical section having a chord progression and other data therein. The musical section and a style provided by the arbitrator are used by the performance engine to generate music sequence data for driving a musical instrument. The performance of the musical sequence data by the musical instrument occurs substantially contemporaneously with the user's interaction which caused the musical section composition. Because the composition engine uses processes which vary the composition of musical sections, the user events which initiate composition of a musical section and which occur at the same place within a multimedia presentation, still vary the performance at each user event.

47 Claims, 15 Drawing Sheets

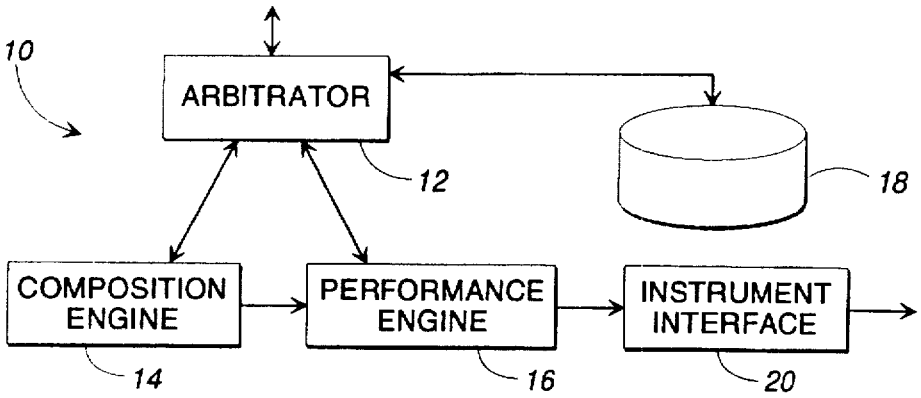
FIG. 1
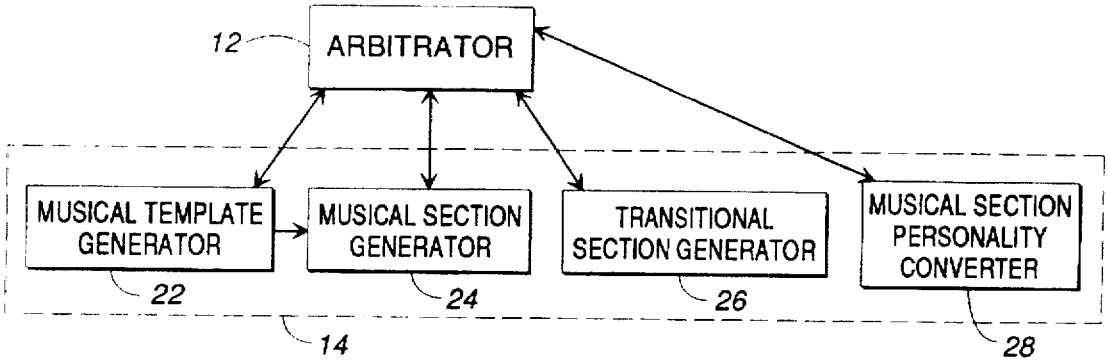
FIG. 2
FIG. 3
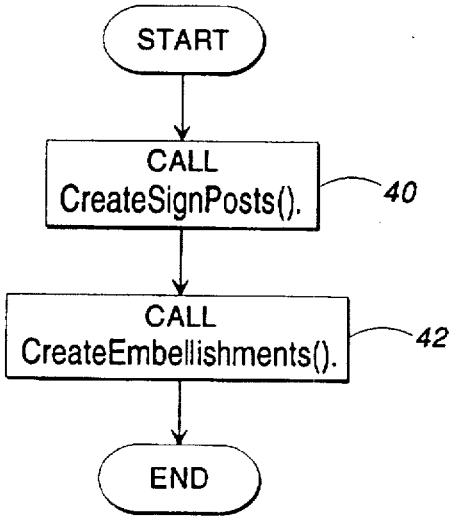

```
// SignPost marker bits (used by SignPost and Command structures):
# define SP_1          0x100     // Choose a chord based on the root note.
# define SP_A          1         // Choose a chord that is very familiar.
# define SP_B          2         // Choose a chord that is less familiar.
# define SP_C          4         // Choose a chord that is less familiar than B.
# define SP_D          8         // Choose a chord that is less familiar than C.
# define SP_E          0x10      // Choose a chord that is less familiar than D.
# define SP_F          0x20      // Choose the most unusual chord.
# define SP_CADENCE    0x8000    // Use Cadence chords leading up to Sign Post.
chord.
```

FIG. 4

```
// Groove and Embellishment command bits (used by Command structure):
# define CMD_FILL      1         // Fill
# define CMD_INTRO     2         // Introduction - used to start.
# define CMD_BREAK     4         // Break
# define CMD_END       8         // Ending
# define CMD_A         0x10      // Groove A (lowest intensity.)
# define CMD_B         0x20      // Groove B (more intensity.)
# define CMD_C         0x40      // Groove C (normal intensity.)
# define CMD_D         0x80      // Groove D (heightened intensity.)
```

FIG. 6

```
class Template {
public:
   int          m_measures;       // Length of template, in measures
   Command*     m_pcommandlist;   // Linked list of command markers
};

class Command {
public:
   Command*     m_pnext;          // Linked list of Commands.
   short        m_measure;        // Time of command, in measures.
   DWORD        m_command;        // Groove and Embellishment flags (FIG. 5.)
   DWORD        m_signpost;       // SignPost chord marker flags (FIG. 9.)
};
```

FIG. 9

```
class Personality {
public:
   ChordEntry*      m_pchordlist;       // List of all chords in chord connection graph.
   SignPost*        m_psignpostlist;    // List of all available sign posts.
   long             m_scalepattern;     // Bit pattern definition of scale.
   ChordPalette     m_chordpalette;     // Palette of Chords for two octaves.
};

class ChordPalette {
public:
   ChordSelection   m_palette[24];      // Two octave set of chords.
};
```

FIG. 10A

```
class SignPost {
public:
   SignPost*        m_pnext;            // Linked list of sign posts.
   ChordSelection   m_chord;            // Chord for sign post.
   ChordSelection   m_cadence[2];       // Two chords for cadence.
   DWORD            m_signposts;        // Which signpost markers supported.
};
```

FIG. 10B

```
class ChordSelection {
public:
   ChordSelection*  m_pnext;            // Linked list of chords (for Section use.)
   long             m_chordpattern;     // Bit pattern that defines chord.
   long             m_scalepattern;     // Bit pattern for underlying scale.
   char             m_root;             // Root note of chord.
   short            m_measure;          // What measure (if in chord progression.)
   char             m_beat;             // What beat this falls on (in progression.)
};
```

FIG. 10C

```
class ChordEntry {
public:
  ChordEntry*       m_pnext;            // Next in Personality's list of ChordEntrys.
  NextChord*        m_pnextchordlist;   // Used to manage set of next possible chords.
  ChordSelection    m_chord;            // This chord.
  unsigned long     m_dwflags;          // Flags (see below.)
};

// m_dwflags:
#define CE_START2                       // Chord to start a progression.
#define CE_END   4                      // Chord to end a progression.

class NextChord {
public:
  NextChord*        m_pnext;            // Linked list of these.
  unsigned long     m_dwflags;          // Flags (see below.)
  ChordEntry*       m_pnextchord;       // Destination chord this points to.
  int               m_nweight;          // Importance of destination chord (0 to 100.)
  int               m_nminbeats;        // Min beats to wait till chord.
  int               m_nmaxbeats;        // Max beats to wait till chord.
};

// m_dwflags carries a set of flags used in the process of walking the tree.
#define NC_PATH   2                     // For walking the tree.
#define NC_NOPATH   4                   // Failed tree walk.
```

*FIG. 10D*

```
class Section {
public:
   Style            m_pstyle;          // Style to perform.
   Personality      m_ppersonality;    // Personality defines scale, chords.
   ChordSelection*  m_pchordlist;      // Chord progression for Section.
   Command*         m_pcommandlist;    // Grooves and Embellishments.
   MIDISequence*    m_peventlist;      // Linked list of time stamped MIDI events.
   int              m_nmeasures;       // Length, in measures.
   int              m_ntempo;          // Tempo, in tenths of  Beats Per Minute.
   int              m_nroot;           // Root of key signature.
};
```

FIG. 12

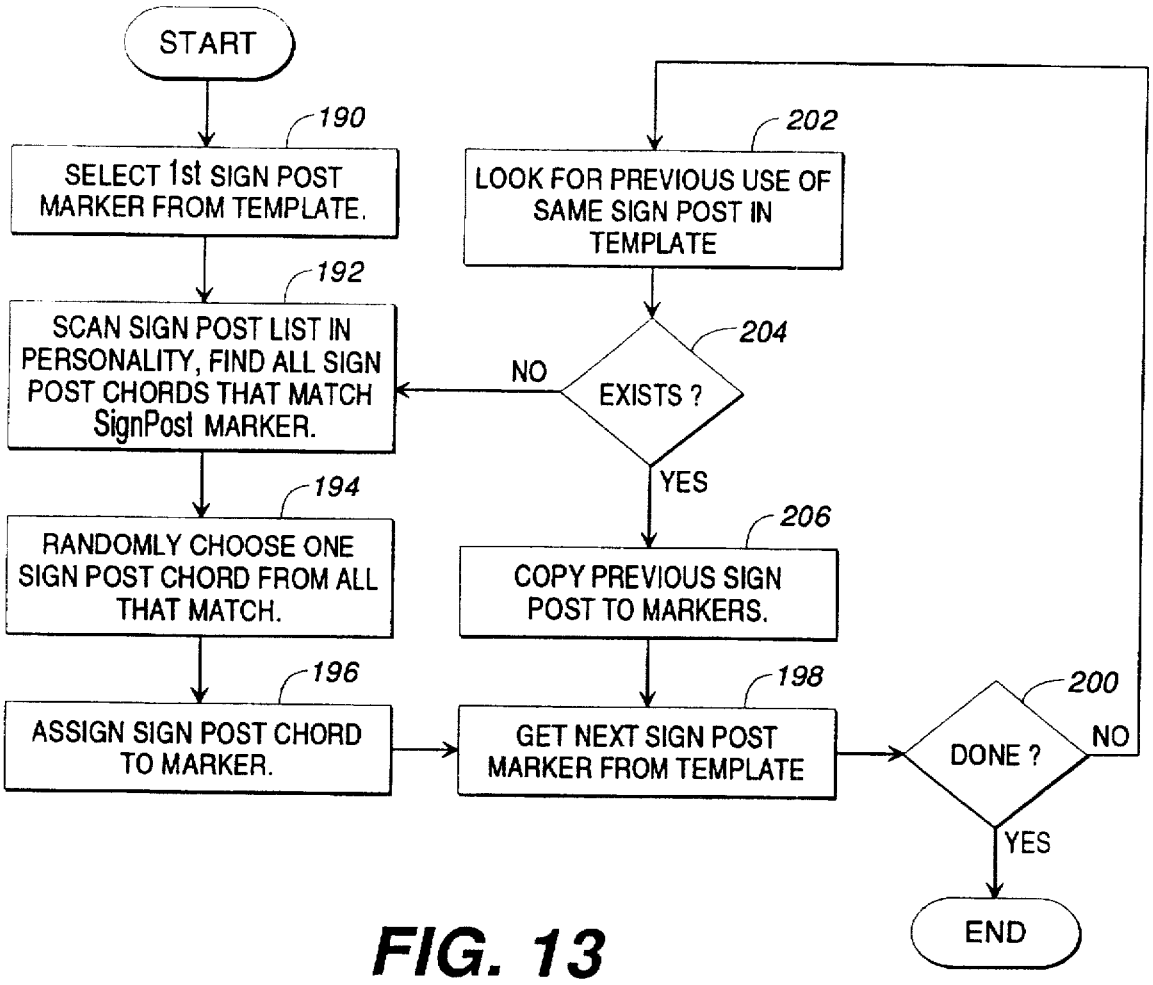

FIG. 13

| OCTAVE | CHORD POSITION | SCALE POSITION | OUT-OF-SCALE POSITION |
|---|---|---|---|

SYSTEM AND PROCESS FOR COMPOSING MUSICAL SECTIONS

FIELD OF THE INVENTION

This invention relates to computer generated music, and more particularly, to computer generated music which enhances a user's interaction with a computer program.

BACKGROUND OF THE INVENTION

Multimedia computer programs are spreading throughout the computer industry. Multimedia programs are viewed as immersing a user in an environment that stimulates learning and enhances entertainment. Such a program does this by presenting data to a user through both audio and video and requires the user to interact with the program through a keyboard, joystick, or the like. An important component to this multimedia presentation is the music sometimes performed during a presentation. Although the music is most often not a dominant part of the presentation, a user viewing visually presented data does hear the accompanying musical performance. As a consequence, the user may associate elements of the video performance with the audio performance. This association may facilitate learning of an important concept or make interaction with a program, such as a video game, more enjoyable.

Previously, the music performed during a multimedia presentation is prerecorded, usually in a digital format. The music is typically commenced by the program controlling the multimedia presentation much as a jukebox responds to the selection of a song for a performance. In other words, the same song or musical recording is retrieved and performed in response to the same event each time. The more that a user interacts with the multimedia presentation, the more the user hears the music. After a number of times, the user may tire of the same musical accompaniment and consider it monotonous or even irritating. As a consequence, the music becomes less useful in stimulating the user and enhancing the multimedia presentation.

Another problem with typical multimedia presentations is sudden musical transitions. Typically, each scene of a multimedia presentation has a particular piece of prerecorded music associated with it. When that scene commences, the musical performance begins as discussed above. If a user decides to transition to an auxiliary presentation, such as an associated lesson, or performs an action which terminates the presentation, such as "killing" the enemy in a video game, the application program transitions to a new scene. Typically, the multimedia musical performance simply terminates the currently playing musical sequence and initiates the prerecorded music for the new section. There may be no musical relationship between the music associated with the first and second scenes and the transition may appear to be disjointed and disrupt the user's interaction as a result.

One attempt to deal with the musical transition problem is disclosed in U.S. Pat. No. 5,315,057 to Land, et al. That patent teaches a method of providing a number of predetermined decision points at which an evaluation is made to determine if a particular event has occurred. If it has, the program selects a transitional musical sequence to more musically transition to the next scene and its associated musical accompaniment. This approach has a number of drawbacks. First, for each event condition, the transition piece is always the same. Thus, if a person is continually encountering the same termination point in a presentation, for example, being unable to answer a question in an educational lesson or unable to overcome some obstacle in a video game, the user always hears the same piece, which may result in the problems previously noted. Second, the effort to identify and program the decision points and where they should be evaluated during a multimedia presentation is an extremely labor intensive effort.

What is needed is a way of providing fresh musical data to accompany a multimedia presentation or portions of the presentation each time it is presented. What is needed is a way of transitioning from one scene of a multimedia presentation to another without requiring labor intensive programming of each predetermined decision point.

SUMMARY OF THE INVENTION

The above noted problems are solved by a musical composition system built in accordance with the principles of the present invention. The system includes an application program interface for receiving parameters that identify the type of music which enhances a user's interaction with the multimedia presentation and a composition engine for composing a musical section that corresponds to the parameters from the application program. The requested music type is identified by a style, a shape, and a personality. The composed musical section defines a chord progression and groove embellishment commands. The section is used by a performance engine to perform music so that the user perceives the performance of the composed musical section to be contemporaneous with the action which initiated the composition.

Because the composition engine may compose a new musical section in response to events initiated by a user, the music corresponding to the composed section usually varies for each performance. As a result, the user maintains her interest in the educational program or game. Because the parameters do not define the musical content for a performance, such as a chord progression or the notes, the composition engine is driven without requiring extensive knowledge of music. Instead, the application program may simply request a musical performance by identifying a shape, a style, and a personality. For example, in response to a user's action with a multimedia event, the application program may request the performance of a "rising, angry" piece in a jazz style.

When the application program provides the composition engine with a request for a transition to a new musical piece, the composition engine responds with a composed transitional section that correlates the music currently being performed to the music associated with the new scene. The composition engine is able to compose the transitional section and synchronize it with the current musical performance virtually anywhere in the ongoing performance.

The composition engine of the present invention may include a template generator which builds a template for describing and defining the musical shape of the musical section to be composed. The composition engine uses a template and a personality to compose a musical section. A personality is preferably a predetermined data structure which contains information to musically define a particular mood. Personalities are identified by terms such as "upbeat," "miserable," "weary," "tense," or "majestic."

Each personality contains a list of connection chords, an appropriate musical scale, a list of important chords for the personality called signpost chords, and a chord palette which is a list of chords which "fit" the particular personality. These data structures are used to complete the information provided by a template to create the musical content for a musical section so it may be later performed. This musical information includes a chord progression, groove commands, and embellishment commands which are used by the performance engine.

Once the musical section has been composed, it may be passed to the performance engine to generate a music sequence. A music sequence is comprised of the instrument commands for a musical device which performs a musical piece. Typically, the composed musical section is provided to the performance engine near the conclusion of the currently performed section to maintain musical continuity in the performance. Should a transition be required, however, the transition section is provided to the performance engine with a command to end the current music performance at an appropriate location, such as the end of a current measure. The performance engine then commences the performance of the newly composed transitional section followed by the next musical section. In this way, there is a smooth and continuous performance of music which transitions from one section to another in a pleasing and melodic fashion.

The composition engine may specifically compose transitional sections in response to parameters received from the application program interface. The parameters received include identification of the current and destination musical sections, the time when the transition should occur, and a flag indicating whether an embellishment is required. The composition engine uses the personality of the destination section and the contents of the current musical section to compose the transitional section. This transitional section is then passed to the performance engine for generation of a music sequence.

The composition engine of the present invention also responds to a parameter from the application interface to change the personality of a music section. To change the personality of a section, the composition engine uses the information from the selected personality to change the chords of a musical section. The engine may also alter the chords of the musical section to conform to the musical scale or key of the new personality. Because a scale change may alter the type of key for a musical section, for instance from major to minor, this change may significantly alter the music corresponding to a musical section.

The system of the present invention may also include a performance engine to generate a music sequence from a musical section and a style. A style is a predetermined data structure that defines the note patterns for each instrument voice. The performance engine of the inventive system includes the capability of performing a motif in response to parameters received from an application program. A motif is a short musical pattern that is typically associated with a particular character or event presented in a multimedia presentation. The performance engine responds to parameters indicating the type of synchronization that should occur, and appropriately synchronizes the playing of the motif section with the current musical section. The motif section also includes a plurality of note patterns for the motif. The performance engine of the present invention may select one of the note patterns for the motif and transpose the pattern so it corresponds to a musical section presently being performed for a multimedia scene. The variations for the musical sections arising from the composition method and the variations of the note patterns for the motifs help ensure that the motifs differ for each performance.

Because the system of the present invention is able to compose musical and transitional sections, transpose motifs, and alter the personality of a musical section based upon a user's interaction with a multimedia presentation, it usually provides new accompaniment to the scenes of a multimedia presentation for each performance of the scenes. Because the application program may request music by only identifying a style, shape, and personality, the application interface of the present invention provides a simple method for composing a chord progression without requiring the application programmer to have knowledge of music theory. These and other advantages of features in the present invention shall become apparent to the reader in view of the accompanying drawings and detailed description.

BRIEF DESCRIPTION OF THE DRAWINGS

The present invention may take form in various components and arrangement of components and in various steps and arrangement of steps. The drawings are only for purposes of illustrating a preferred embodiment and processes and are not to be construed as limiting the invention.

FIG. 1 is a block diagram of a system implementing the principles of the present invention;

FIG. 2 is a block diagram of the composition engine shown in FIG. 1;

FIG. 3 is a flowchart of the preferred process for composing musical templates in the composition engine shown in FIG. 1;

FIG. 4 shows a preferred set of signpost chord markers;

FIG. 6 is a data structure definition of the embellishment and groove commands used in the preferred process shown in FIG. 7;

FIG. 9 is a data structure definition of a template constructed by the processes shown in FIGS. 5, 7 and 8;

FIGS. 10A–D are data structures for a personality used by the musical section generator of FIG. 2 to compose a musical section;

FIG. 12 is a data structure definition of a musical section generated by the composition engine of FIG. 1;

FIG. 13 is a flowchart of a preferred process for assigning signpost chord markers in a template which is part of the process shown in FIG. 11;

DETAILED DESCRIPTION OF THE INVENTION

Figure 5:
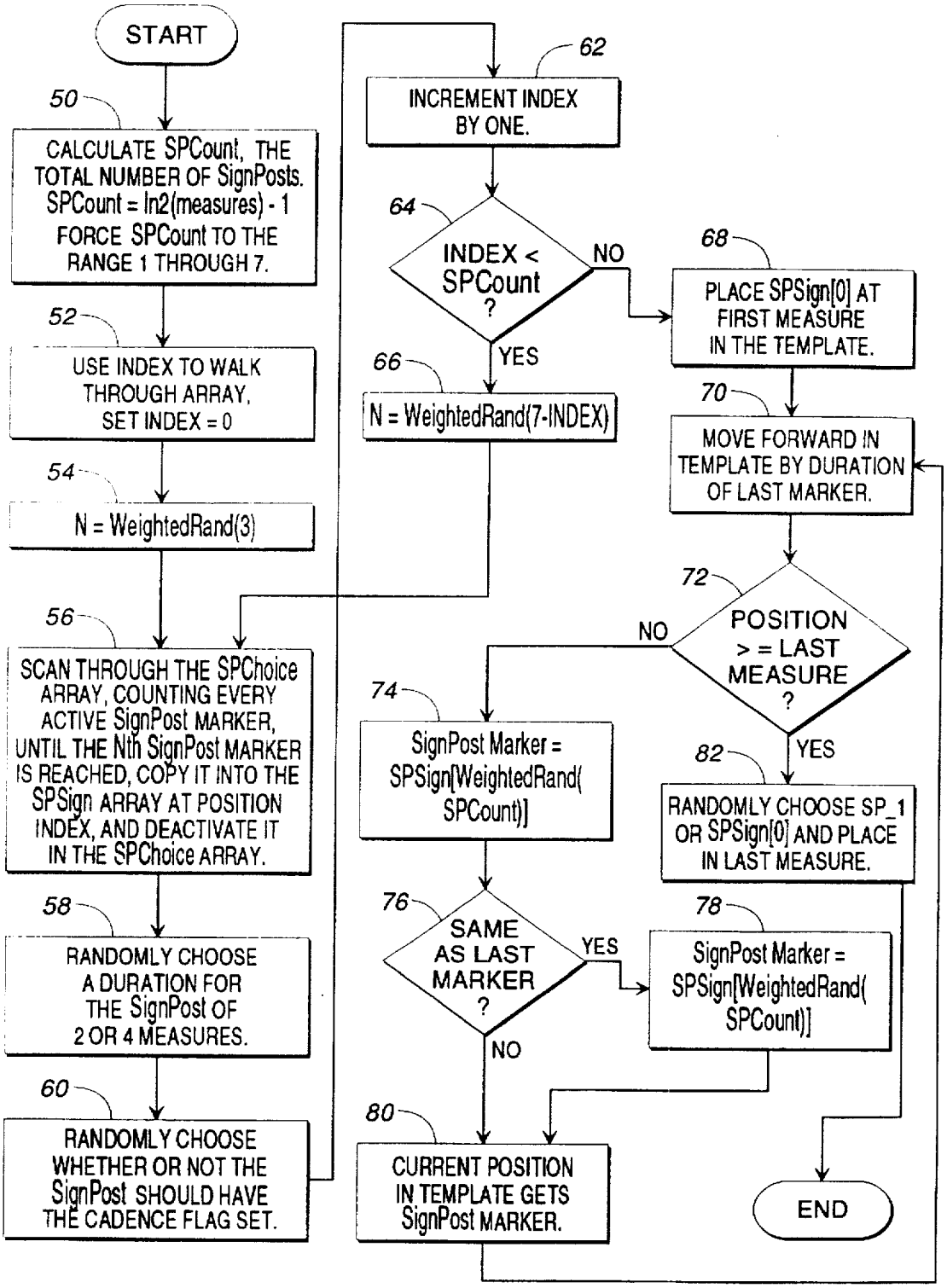
FIG. 5 is a flowchart of the preferred process to place signpost chord markers in a template used in the musical template generator shown in FIG. 2.

A system incorporating the principles of the present invention is shown in FIG. 1. The system 10 includes an arbitrator 12, a composition engine 14, a performance engine 16, data storage 18, and an instrument interface 20. The arbitrator 12 preferably receives from an application program which is driving a multimedia presentation information or parameters about the shape, style, and personality for a requested musical performance. Alternatively, all or a portion of the arbitrator 12 may be incorporated in the application program. Based upon the information received from the application program, arbitrator 12 may access data storage 18 to provide musical sections and styles to performance engine 16 for generation of a music sequence, or pass parameters to composition engine 14 for the composition of a musical section. Additionally, arbitrator 12 receives feedback regarding the performance of a musical section from performance engine 16 and provides all or a portion of that feedback to the application program.

Further details of composition engine 14 are shown in FIG. 2. Composition engine 14 performs functions or processes to compose musical sections in immediate response to user interaction with the application program. These functions are implemented by musical template generator 22, musical section generator 24, transitional section generator 26, and musical section personality converter 28. The musical template generator 22 generates a template data structure that defines the musical shape of a musical section. The musical section generator 24 of composition engine 14 uses a musical template and a personality data structure (discussed in more detail below) received from arbitrator 12 to compose a musical section. The content of a musical section is provided in more detail below. This section may be provided to performance engine 16 for an interpretative performance or it may be returned to arbitrator 12 for storage on data storage 18. The transitional section generator 26 generates a musical section that is specifically tailored to transition from the performance of a current musical section to a destination musical section. The musical section personality converter 28 alters the chords of a musical section that is currently being performed with musical data from a second personality.

The performance engine 16 uses a musical section and a musical style to generate a musical sequence. The style data are predetermined and stored on data storage 18. Arbitrator 12 retrieves a musical style and provides the style to performance engine 16 to interpret the composed musical section. Additionally, arbitrator 12 may provide motif sections retrieved from a data storage 18 to performance engine 16. Arbitrator 12 provides the data structures in response to signals from the application program driving the multimedia presentation. The music sequence generated by performance engine 16 identifies the notes to be played by a musical device driven by the performance engine 16. The musical sequence information is provided to the device through an instrument interface 20 which preferably is a Musical Instrument Digital Interface (MIDI).

Performance engine 16 also provides the application program via arbitrator 12 feedback messages so the application program may coordinate the various components of the multimedia presentation. The feedback messages preferably indicate that a musical section has started, a musical section has ended, a musical section has been requested, a note has been played, a beat or measure has passed, a groove level has changed, or an embellishment has occurred. Other messages necessary for coordinating a multimedia presentation with a musical performance may also be used.

Preferably, the arbitrator 12, composition engine 14, performance engine 16, and data storage 18 are implemented on a computer system having at least an INTEL 386SX processor with at least two megabytes of RAM and at least five megabytes of disc storage space. The instrument interface 20 may be a MIDI such as that manufactured by MidiMan of Pasadena, Calif., or a sound card such as that manufactured by Ensonig of Malvern, Pa. Performance engine 16 is of the type as the one implemented in the SuperJAM!™ program available from The Blue Ribbon SoundWorks of Atlanta, Ga. Preferably, composition engine 14 and performance engine 16 are implemented in the C++ or C programming languages.

A preferred process performed by the musical template generator 22 is shown in FIG. 3. This process specifies the complexity and location of musically important chords for a musical section and defines the musical activity levels and types for the section as well. The process begins by invoking a create signposts process (shown in FIG. 5) which places signpost chord markers in an empty template data structure. (Step 40). After the signpost chord markers are placed in the template, a second process (shown in FIG. 7) is invoked to provide embellishment commands in the template. (Step 42). Preferably, the embellishment commands include groove level commands which are related to a shape parameter associated with the template.

Once the template has been generated, it may be used by the musical section generator 24 to add the musical content for the section.

The process for placing signpost chord markers in a template provides a framework for the later composition of a musical section. Signpost chord markers indicate a location for signpost chords in a musical section. Signpost chords are chords that are musically important to a musical section. For example, chords based on the first, fourth, and fifth positions of a scale are typically regarded as musically significant. Signpost chord markers are preferably identified as an ordered set of elements such as the bit flags shown in FIG. 4. Each element defines a level of complexity for a chord. For example, SP_1 may represent a chord based on the root for the scale associated with a personality and SP_A may represent a chord that is based on a note less musically common to the scale than one built on the root. Preferably, each element SP_C to SP_F relates to a continuum of chord complexity within the scale. For example, SP_F may represent a very unusual chord for the scale such as a diminished second chord in a major key. The signpost chord markers may be defined according to other characteristics such as position in a scale.

The preferred create signposts process shown in FIG. 5 calculates musically appropriate locations in a template for signpost chords and marks these locations with signpost chord markers selected from the signpost chord marker set discussed above. Preferably, a weighted random number generator is used to generate an offset into the set of signpost chord markers. The weighted random number generator randomly generates an integer within the range of 0 to an upper limit which is usually passed to the generator as a parameter. The distribution of the integers returned by the generator is preferably weighted to the lower end of the range. Thus, the process shown in FIG. 5 tends to select signpost chord markers which represent less complex chords, although other criteria and methods may be used to select such chords for a template-like structure.

The process of FIG. 5 begins by calculating the number of signpost chord markers, SPCount, that should be placed within a template. (Step 50). Preferably, this number is calculated by subtracting 1 from the binary logarithm of the number of measures for the template. For example, if the template length is 8 measures then the binary logarithm of 8 is 3 since 8 equals 23. Thus, for an 8 measure template, the number of signpost chord markers to be placed within the template is 2. If the calculation of the signpost chord marker number exceeds 7, then the number is preferably reduced to be within the range of 1 through 7, since the preferred signpost chord marker set only has seven elements.

Preferably, the weighted random number generator is used to generate a number used to select signpost chord markers from the signpost chord marker set. (Steps 52–54). After a marker is selected, it is preferably copied into an SPSign array and deactivated as a choice in the signpost chord marker set. (Step 56). A duration for the selected signpost marker, which is preferably 2 or 4 measures, is then randomly selected. (Step 58). The process then randomly selects whether a cadence flag should be set for the selected signpost chord marker. (Step 60). The cadence flag indicates whether cadence chords for the signpost chord marker which are identified in a personality should precede a signpost chord in the musical section to be composed. The cadence flag is identified by the symbol SP_CADENCE in FIG. 4. Signpost chord marker selection continues until the number of selected markers equals the calculated number of signpost chord markers. (Steps 62–66).

Once all the signpost chord markers have been selected and placed in the SPSign array, the signpost chord markers within the SPSign array are placed in the appropriate locations in the template. This is done by placing the first signpost chord marker from the SPSign array on the first beat of the first measure of the template, although other locations may be used. (Step 68). The process then increments by the number of measures indicated for the duration of the placed signpost chord marker (Step 70) and that location is examined to determine whether it is the last measure in the template. (Step 72). If it is not, another weighted random number is generated which is equal to or less than the calculated number of signpost chord markers and used as an index into the SPSign array to randomly select a new signpost chord marker. (Step 74). This signpost chord marker is then examined to see if it is the same as the last signpost chord marker placed within the template. (Step 76). If it is, an attempt is made to randomly select another signpost chord marker from the SPSign array. (Step 78). The preferred process places the signpost chord marker selected by the second attempt in the template (Step 80), although the search for a different chord marker could continue until a different one is selected. The process of placing signpost chord markers continues until the last measure in the template is reached. At that point, the process selects either signpost chord marker SP_1 or the first element in the SPSign array. (Step 82). These chords are preferably selected because they either represent a more traditional end for the section or, as a result of being the first element in the SPSign array, the most frequently selected signpost chord marker for the section. After the signpost chord markers have been inserted in the template, the process returns the template with the signpost chord markers.

Figure 7:
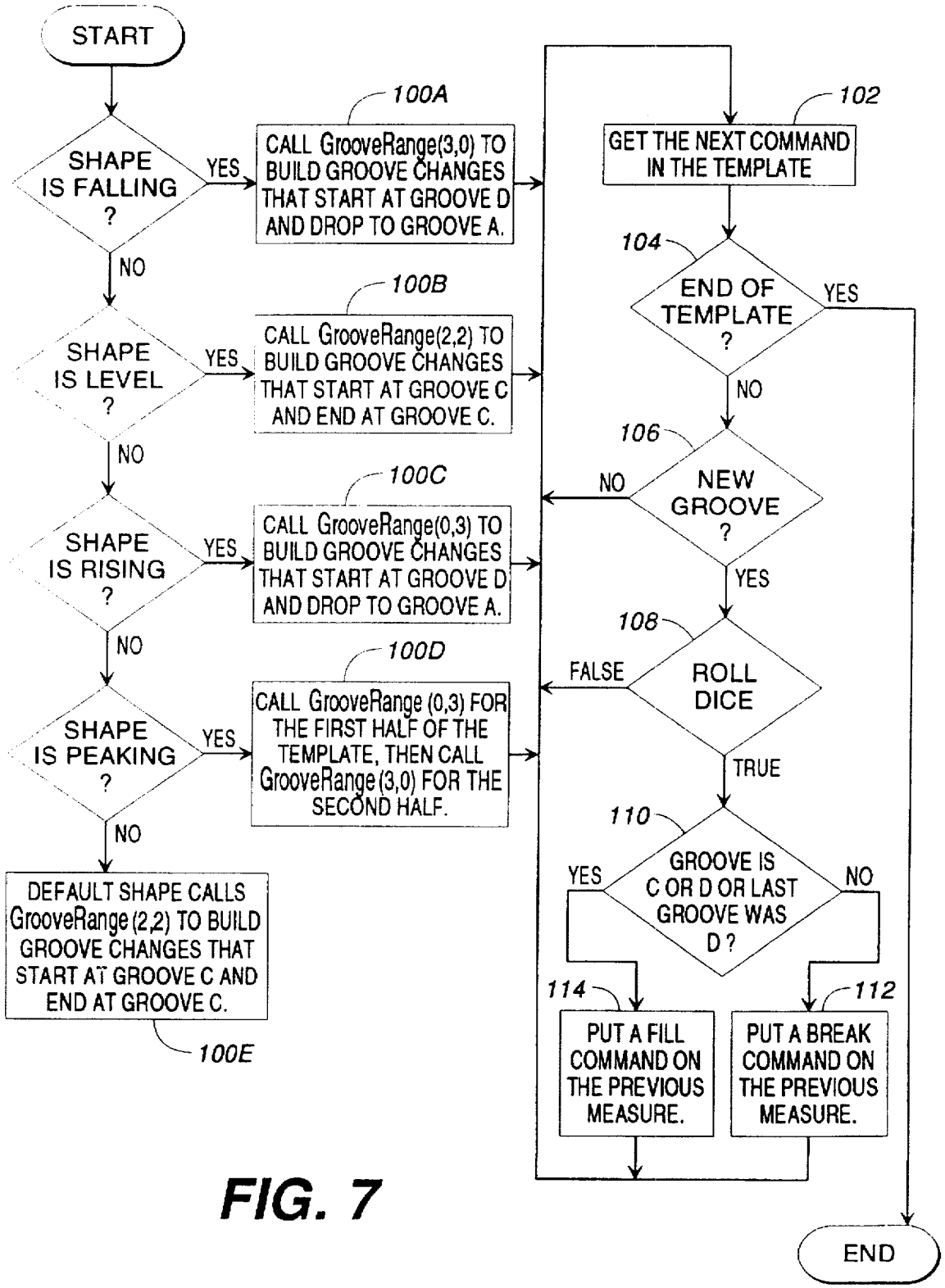
FIG. 7 is a flowchart of a preferred process to place embellishment and groove commands of the type shown in FIG. 6 in a musical template.

The create embellishments process shown in FIG. 7 is used to insert groove commands and embellishment commands in the template. Preferably, embellishment and groove commands are used to indicate the level of intensity for the music within a section. Preferably, there are four embellishment commands and four groove commands. The preferred embellishments and groove commands are shown in FIG. 6. As shown in that FIG., the four embellishment commands are fill, introduction, break, and ending. Musically, these terms mean the following. Fill is a term to indicate a background musical performance that adds musical activity in anticipation of a next measure. Introduction is a short musical performance that starts a musical section. A break is a reduction in musical activity in anticipation of a next measure. Finally, ending is a musically pleasing resolution of a musical section.

The groove commands are identified as groove A, groove B, groove C, and groove D. These define an intensity level for the music with A preferably being the least intense and groove D being the most intense level. Intensity reflects the number of notes being played per unit of time measurement. The greater the number of notes played per unit of time, the greater the intensity. Of course, more groove commands may be provided if a smaller gradation of intensity is desired or the intensity levels may be ordered from greatest to lowest intensity.

The process for generating embellishment and groove commands uses the template in which the signpost chord markers have been placed and a parameter, received from the application program through arbitrator 12, that defines the overall shape of a template. This shape parameter describes the groove level changes over the time duration as defined for a template. Depending upon the shape defined, a groove range process places groove level commands in a template. Once the groove level commands have been placed in a template, they are examined to determine whether fill or break embellishment commands should be inserted into the template. These embellishment commands are included to further increase the number of musical sections which the composition engine may compose.

A process for placing embellishment and groove level commands in a template is shown in more detail in FIG. 7. The process begins by passing the starting and ending groove levels for a section to a process (shown in FIG. 8) for placing groove commands in the template. (Steps 100A–D). For a falling template shape, groove D is identified as the starting groove level and groove A as the ending groove level. (Step 100A). For a level shape, groove C is the starting and ending groove level. (Step 100B). A rising shape begins at groove A and ends at groove D. (Step 100C). For a peaking template shape, the process identifies groove A as the starting groove level and groove D as the ending level for the first half of the template and those identifications are reversed for the second half of the template. (Step 100D). If no shape is defined the process preferably defaults to a level shape (Step 100E), although other shapes may be used for the default shape. Additionally, other shapes may be defined for placing groove commands in the template.

After the groove level commands are inserted into the template, the process examines the inserted groove commands to determine whether further changes should be made to the groove level commands. Where a groove level command differs from a previous groove level command, the process randomly determines whether to make additional changes. (Steps 102–106). If additional changes are made, the process places a fill embellishment command in the measure before the groove command if the present groove command is for a groove C or D level. (Steps 110, 114). If a groove D command precedes the current groove command, it also places a fill embellishment command in the previous measure. (Step 114). If none of these conditions exist and the add embellishment command path has been selected, a break embellishment command is inserted in the previous measure. (Step 112). The process for placing groove and embellishment commands in a template continues until the end of the template is reached. The process then returns the template with the inserted groove and embellishment commands.

Figure 8:
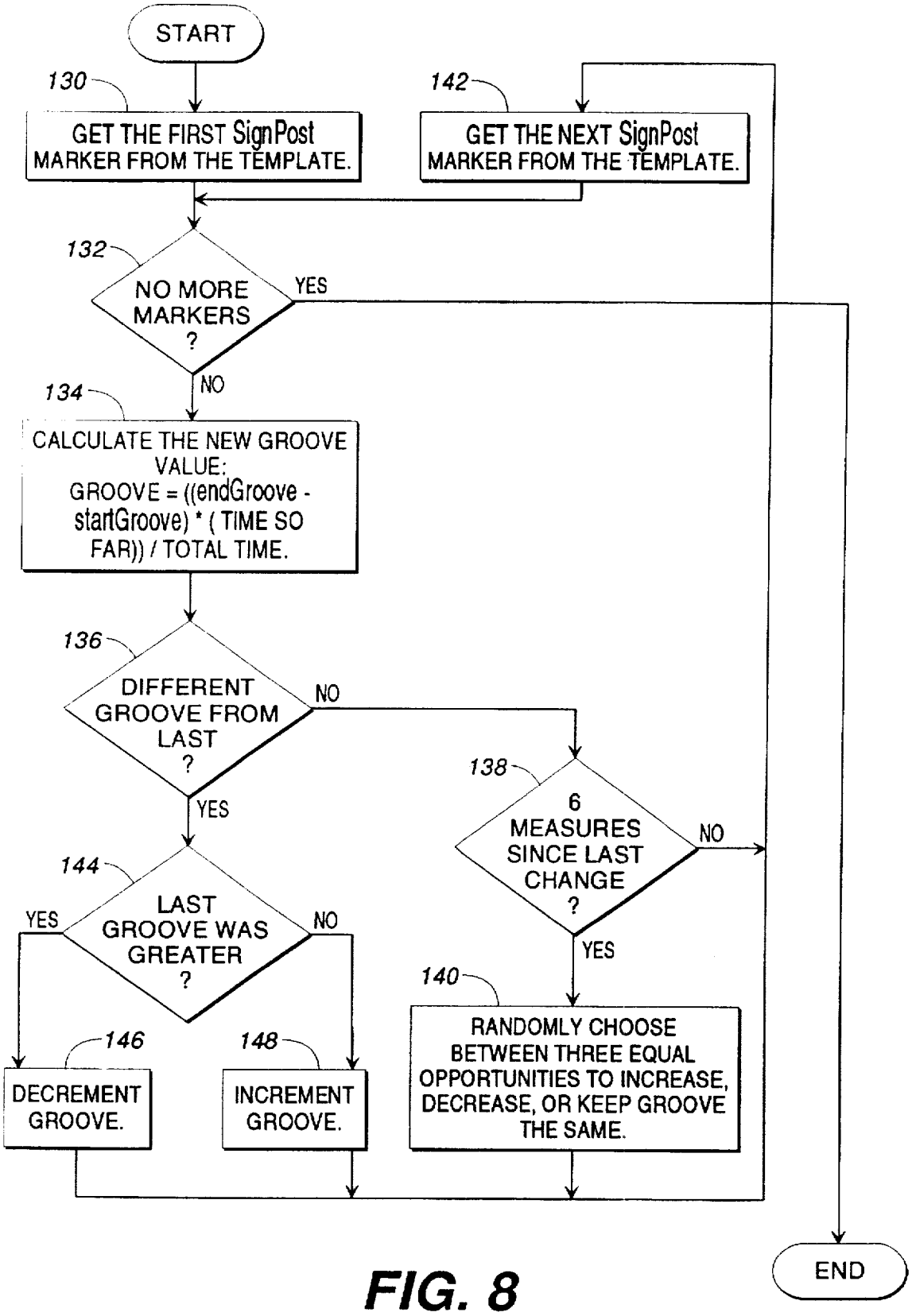
FIG. 8 is a flowchart of a preferred process for calculating the groove level commands for a template.

The preferred groove range process which places groove commands in the template is shown in FIG. 8. The process uses the time duration for the template, preferably measured in beats, along with the starting and ending groove commands to place groove commands throughout the template. The process begins by locating the first signpost chord marker within the template. (Step 130). The process places the starting groove level at the first signpost chord marker in the template. The process then moves to the next signpost chord marker and calculates a groove command for that marker. Preferably, the groove command is equal to the absolute value of the difference between the starting groove level and ending groove level multiplied by the time (preferably measured in beats) at the present location within the template, and this quantity is divided by the total time for the template to generate a groove level. (Step 134).

Having calculated the groove level, it is then compared to the last groove level placed in the template to determine if it is different. (Step 136). If it is not and six measures have passed since the last groove level change, a groove level different than the last groove level placed in the template is randomly selected and placed at the signpost chord marker. (Step 140.) If six measures have not passed, the process searches for the next signpost chord marker. (Step 142). If the calculated groove command is different than the last groove command, the process increases the difference for the calculated level. If the last groove command is greater than the calculated level, the calculated groove level is decremented to further decrease the difference from the prior groove level command. (Steps 144, 146). Otherwise, the groove level is incremented to increase the difference. (Steps 144, 148). This preferred augmentation of groove level differences further enhances the interesting qualities of the musical section composed by using the template. The groove command process continues until there are no more signpost markers within the template and the process returns the template with the inserted groove level commands.

After the musical template section generator 22 has performed the processes described above, a musical template defining the signpost chord locations and music intensity levels has been constructed. The preferred data structure for a musical template is shown in FIG. 9. This data structure may now be stored by arbitrator 12 in data storage 18 for later use or it may be passed to musical section generator 24 for composition of a musical section. Additionally, predetermined templates not generated by musical template generator 22 may be stored in data storage 18 for composition of a musical section. The musical section generator 24 uses a template, preferably retrieved from data storage 18 by arbitrator 12, and a personality to compose a musical section.

A personality is a data structure that includes sufficient information for composing a chord progression for a section. This information is structured so that a different section may be composed in response to composition commands even though the same template and personality may be used. Thus, the process for generating musical sections of the present invention may compose original musical sections that differ regardless of whether it generates a template or is supplied one.

Preferably, the personalities are defined prior to use of the system shown in FIG. 1 and are stored on data storage element 18. The exemplary personality and associated data structures shown in FIGS. 10A–D include a chord entry list, a signpost chord list, a scale pattern, and a chord palette. The chord entry list is an acyclic graph of chord connections that "fit" the mood of the personality defined by the structure. Each chord in the list has a next chord data structure that has one or more pointers, each of which point to a next chord which may follow the chord. Each such pointer also has a probability weight associated with it, to facilitate selection of a next chord. In this way, a chord progression built from the chords selected from the chord list of a particular personality is not always the same. The signpost chord list identifies the chord or chords that correspond to each signpost marker. The scale pattern is preferably a string of twelve (12) bits to identify the notes of a scale for a personality. For example, a major scale string would be "101011010101," while a minor key would be "101101010110." Preferably, the chord palette is a list of chords, one chord for each note of a two octave range with each note of the two octave range forming the root of its corresponding chord.

Preferably, a personality is a data structure as shown in FIG. 10A. That structure includes a list of chords and pointers from which a chord progression may be defined, a list of sign post chords that fit the personality, the scale for the personality, and an array of chords for a two octave range. Each note of the two octave array has a corresponding chord within the chord array. The preferred structure for the chord array is called a chord palette and is shown in the figure. A preferred data structure that defines the signpost list is shown in FIG. 10B. That structure includes a pointer to link the signpost chord list, identification of the signpost chord and the associated cadence chords, and a set of flags which indicate which signpost chord markers correspond to this signpost chord.

The preferred data structure that defines a chord is shown in FIG. 10C. That structure includes a definition of the notes of the chord, the scale of the chord, and the root note of the chord. Two data fields are provided in the preferred structure which may be used to identify the measure and beat within a section on which the chord is located.

Chord entry data structures have the preferred form shown in FIG. 10D. The chord entry structure contains a next chord structure for constructing a chord progression, the musical identification of the chord (such as Cmajor), and flags which are to used to identify whether the chord is the beginning or ending chord of a progression. The next chord data structure includes a flag which indicates whether the chord is in a chord path being walked, a pointer to a next chord to evaluate for the connecting chord path, the probability that the next chord should be selected as a next chord candidate, preferably expressed as number from 0 to 100, and the maximum and minimum number of beats to the next chord. While the data structures in FIGS. 10A–D are the preferred ones for the system and processes of the present invention, other structures may be used which include the same or similar information for defining chords and their musical relationships.

Figure 11:
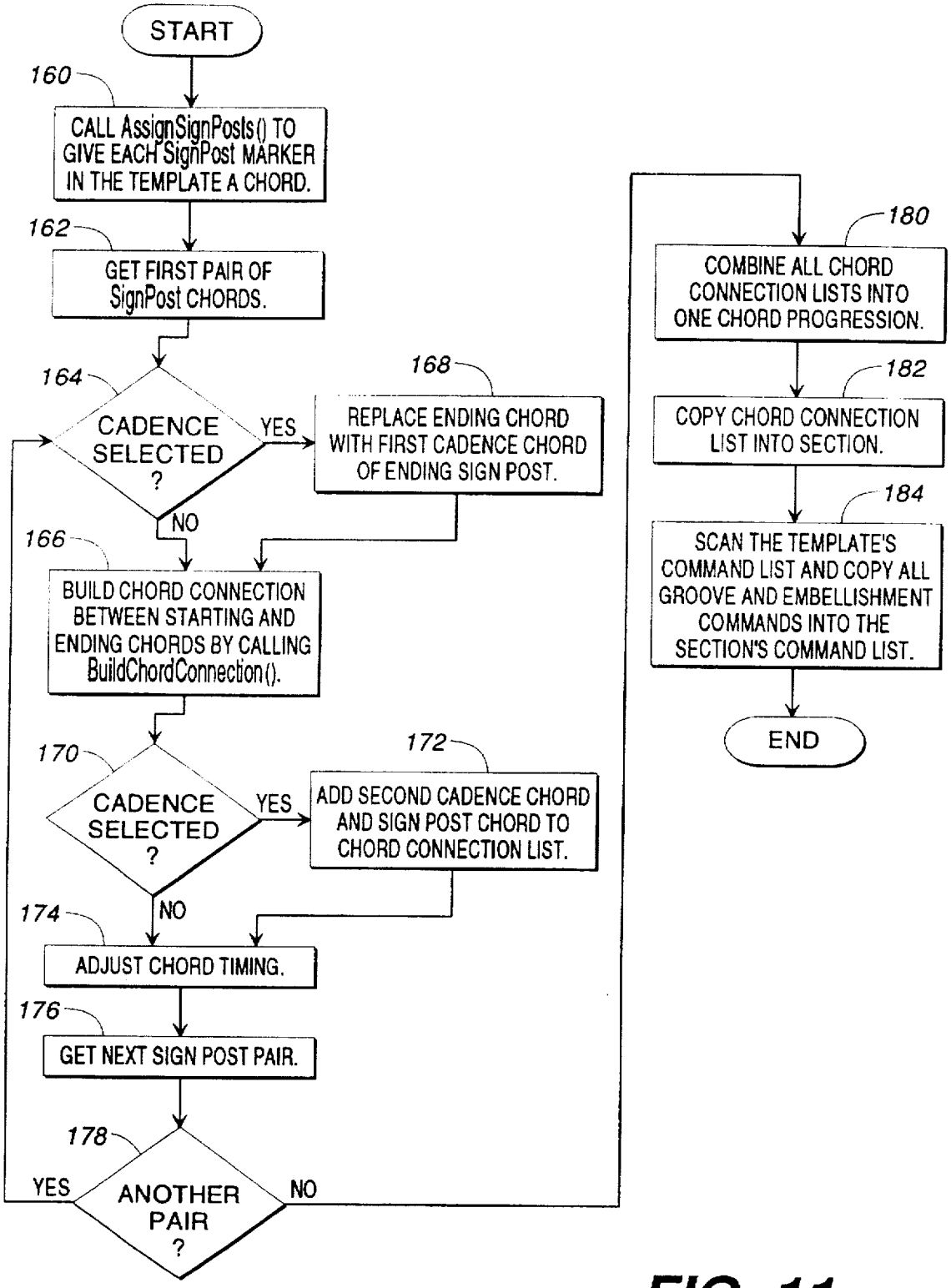
FIG. 11 is a flowchart of a preferred process which composes a musical section in the composition engine shown in FIG. 1.

The preferred process performed by musical section generator 24 for generating a musical section is shown in FIG. 11. It begins by having an assign signposts process (shown in FIG. 13) assign a chord from the signpost chord list of a personality to each signpost chord marker within a template. (Step 160). The process selects a starting and ending chord pair and determines if the cadence flag is set for the ending chord. (Step 164). If it is, then the ending chord is replaced with the first cadence chord. (Step 168). The build chord connection process (shown in FIG. 14) then finds the connecting chord path between the starting and ending chords. (Step 166). If the cadence flag was set (Step 170), the remaining cadence chords and signpost chord are added to the chord connection list. (Step 172). The timing of the chords with respect to the measure boundaries is then adjusted. Preferably, the process evenly spaces the chords over the section and then determines whether the chords not on measure boundaries may be moved to an adjacent measure boundary. If so, the chord time is adjusted, otherwise the chord is left at its current position. A chord may not be moved to a measure boundary if a chord already occupies the boundary. When all of the signpost chords have been connected and adjusted, the chord progression is written to a musical section. (Steps 180, 182). Finally, the embellishment and groove level commands of the template are written to the musical section. (Step 184).

A preferred data structure for a musical section is shown in FIG. 12. The structure includes the style, personality, chord progression, groove and embellishment commands, MIDI sequence data, section length, tempo, and root of the key. The musical section generator 24 generates the chord progression and places the commands in the data structure. The style, personality, section length, tempo, and key root are provided by arbitrator 12 either from data storage 18 or from the application program. The MIDI sequence data is predetermined data that is not used by composition engine 14 for its processes and does not form part of the present invention.

The preferred process which assigns signpost chords from the signpost chord list in a personality to each signpost chord marker in a template is shown in FIG. 13. This process begins by selecting the first signpost chord marker in the template. (Step 190). The process then scans the signpost chord list associated with a personality to find all the signpost chords that correspond to the selected signpost chord marker. (Step 192). The process then randomly selects one of the corresponding signpost chords and assigns it to the selected signpost chord marker. (Steps 194, 196). The process then looks for another signpost chord marker in the template. (Steps 198, 200). If there is, it determines if a prior signpost chord marker is the same as the current signpost marker. (Steps 202, 204). If it is, the signpost chord assigned to the prior signpost chord marker is assigned to the current signpost marker and the process continues by looking for another signpost chord marker. (Steps 206 and 198, 200). If the current signpost marker is not the same as a previously selected signpost chord marker, the signpost chord list in the personality for that signpost chord marker is scanned and one of the corresponding chords in the list is randomly selected for assignment to the signpost chord marker. This process continues until all the signpost chord markers in the template have been assigned a signpost chord.

Figure 14:
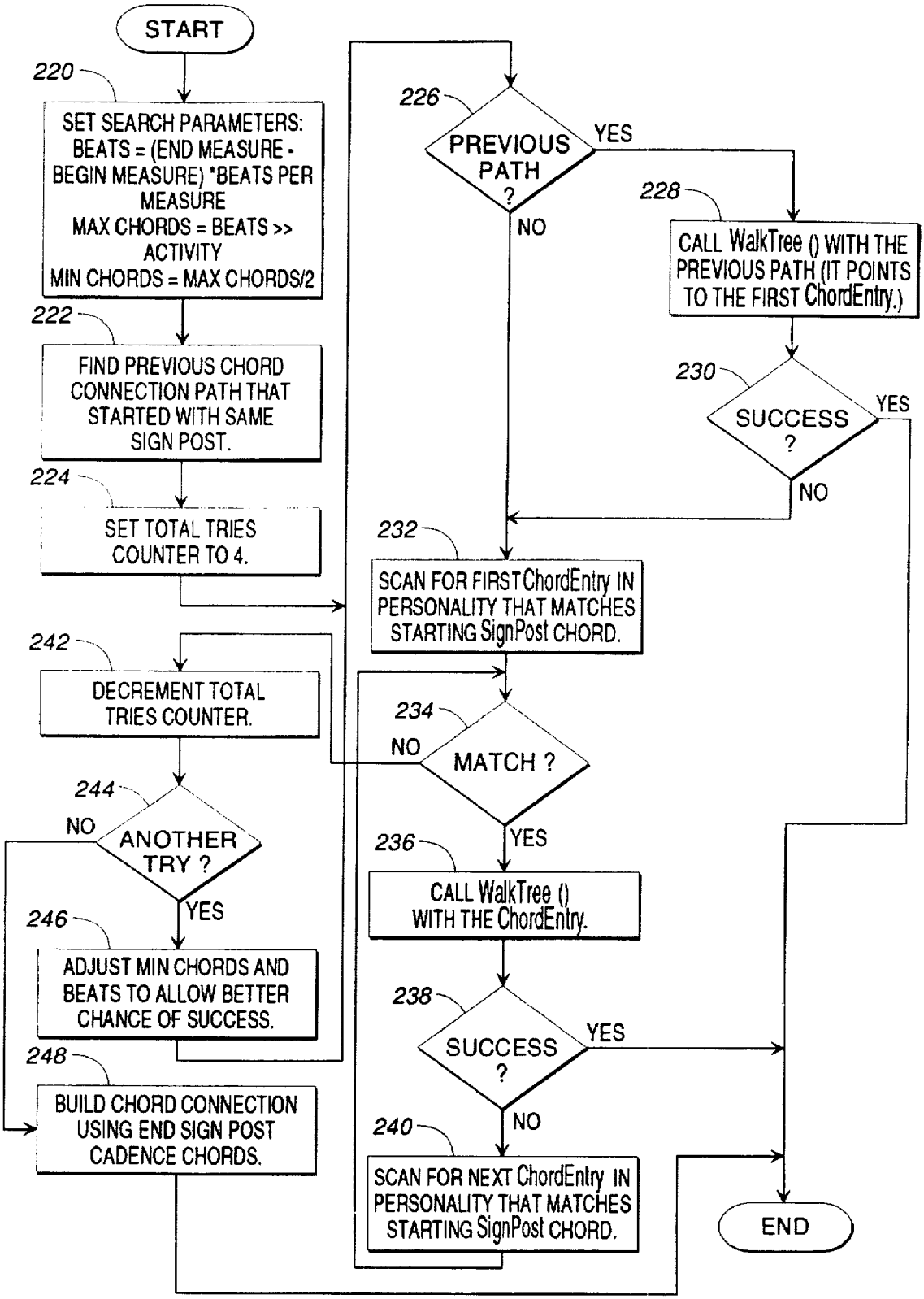
FIG. 14 is a flowchart of a preferred process which builds a chord connecting path between two successive signpost chords for the musical section generator of FIG. 2.

The preferred process for building a chord connection path between two successive signpost chords (the starting and ending chords) is shown in FIG. 14. This process receives as parameters the starting and ending chords, the chord activity level, and the beats per measure. Preferably, chord activity level is a parameter having a value of 0 to 3 which defines how frequently chords change. In the preferred scheme, 0 is the least amount of change which preferably corresponds to a chord change every two measures and 3 is the largest which preferably corresponds to a chord change on each beat. The process begins by determining the number of beats for the template. This is done by computing the length of the template in measures and multiplying that number by the number of beats per measure. The value for the maximum number of chords is set to a number corresponding to the number of beats for the template. Preferably, the maximum number is the number of beats expressed as a binary number shifted right by the value of the activity level, although other computational schemes may be used. The minimum number of chords for the section is set to one-half of the maximum number. (Step 220).

The process then searches to see if a previous chord connection has been generated that began with the same starting signpost chord. (Steps 222–226). If there is such a previous chord connection, the walk tree process (shown in FIG. 15) is used to see if that chord connection path may be used to connect the starting chord to the current ending chord. (Step 228). If it can be, that chord connection path is selected and the process ends. (Step 230). If the chord connection path cannot reach the ending signpost chord, then the chord entries in the chord entry list of the personality data structure are searched to find the first one that matches the starting signpost chord. (Step 232). If there is a match, then the walk tree process is called to determine if the next chord pointer may be used to form a chord connection path to the ending chord. (Steps 234, 236). If it can be, that connection list is selected and returned to the music section generating process. (Step 238). If it cannot be constructed, then the chord entry list of the personality is searched for another entry that matches the current signpost chord (Step 240) and the process continues. (Steps 234–238). If no chord entry within the personality matches the starting signpost chord (Steps 234 and 242, 244), the minimum number of chords and beats are adjusted to provide a better chance of success for finding a path (Step 246) and the process is repeated. (Steps 226–240). Preferably, the minimum chord number is reduced because a path connecting the starting and ending chord may probably be found if fewer chords are needed.

If the process does not locate a chord connection path after a predetermined number of tries (Step 244), a chord connection is built between the two chords by using the cadence chords associated with the ending signpost chord. If the ending chord is a cadence chord then the connecting path is composed of the starting and ending chord. Cadence chords are preferably identified by a data structure associated with a signpost chord entry in the signpost chord list. Preferably, one or two cadence chords are in the data structure although other numbers of such chords may be used. Cadence chords are preferably chords that musically resolve to the signpost chord entry.

Figure 15:
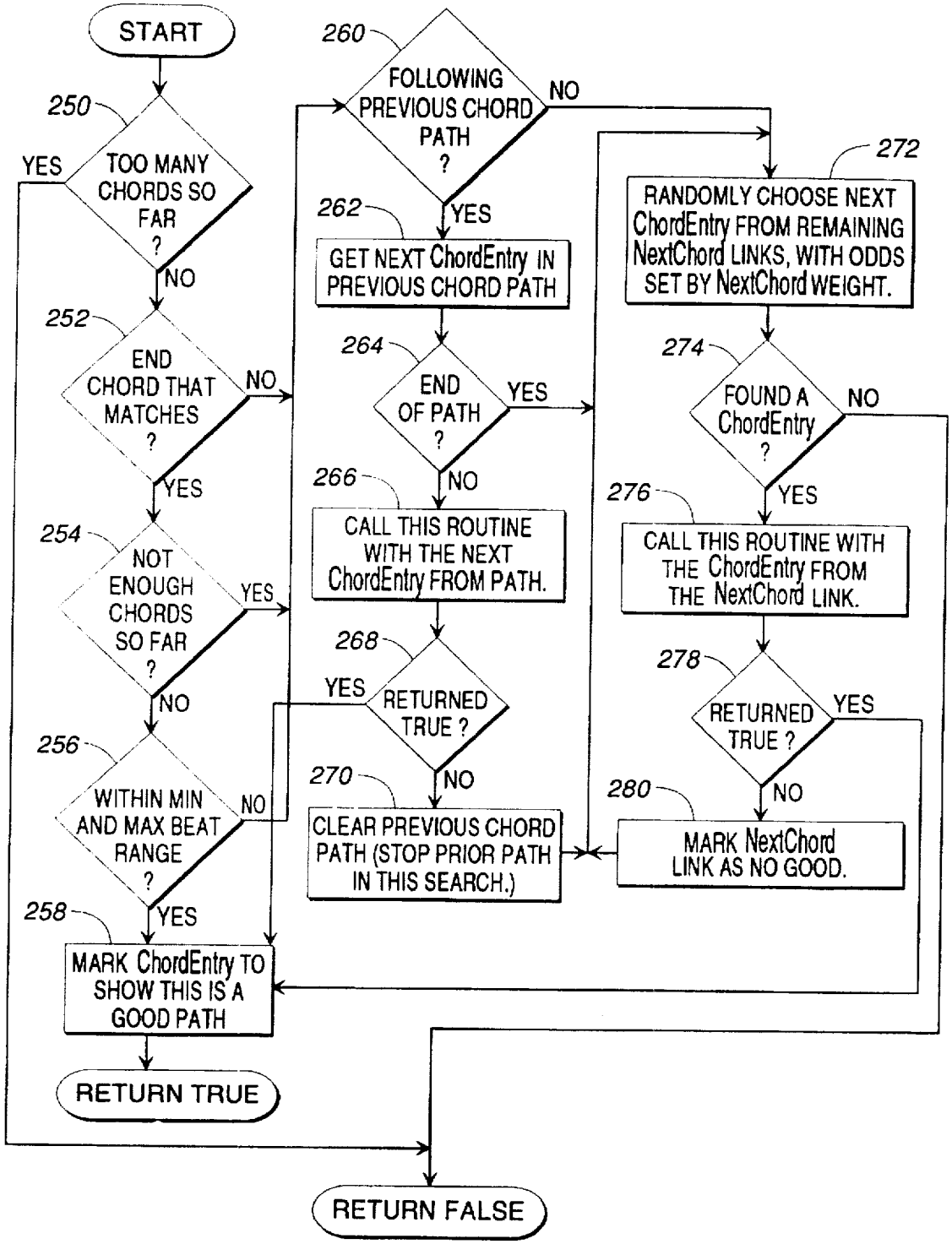
FIG. 15 is a flowchart of a preferred recursive process of musical section generator shown in FIG. 2 which traverses a path defined by next chord pointers to determine whether a chord connecting path between two successive signpost chords satisfies the criteria for a valid chord connecting path.

The walk tree process is shown in FIG. 15. This process is a recursive routine that determines whether a chord connection path between the starting and ending signpost chords is possible. The process is initiated with a specific chord entry selected from the chord entry list of a personality. The process looks at the next chord pointer of the chord entry and evaluates whether it is the last chord and, if it is, determines whether the path satisfies the chord activity and beat requirements. If it does, the connecting path is identified. Otherwise, the process continues to search for a valid connecting path between the starting and ending signpost chords.

The walk tree process of FIG. 15 begins by determining whether there are too many chords between the starting and ending signpost chords currently. (Step 250). If there are, the process returns a Boolean value that indicates a valid connecting path was not found. If there are not too many chords in the current path, it evaluates whether the current chord entry matches the ending signpost chord (Step 252) and, if it does not, evaluates whether it is following a previous chord path or not. (Step 260). If it is, it selects the next chord entry from that previous path (Step 262) and recursively calls the walk tree process if the chord entry is not the end of the prior path. (Step 264, 266). If the process can reach the end of the path then a true value is returned and the chord connection path is used. (Steps 268, 258). If the prior chord path cannot be traversed to the end, then that chord path is cleared as being available for the current path search. (Step 270).

If no previous chord path is being followed or if the previous chord path has been cleared, then the process randomly selects the next chord entry identified by the next chord data pointer of a chord entry in the chord entry list of a personality. (Step 272). The probabilities associated with the next chord pointers are used to randomly select one of the next chords. After a chord entry corresponding to the next chord is selected, the walk tree process is recursively called to see if a path can be traversed to the ending signpost chord. (Step 276). If the routine is able to do so, then a Boolean value indicating the chord connection path is valid is returned. (Steps 278, 280). Otherwise, the process indicates that no connecting chord path is available. (Steps 278, 280). In this manner, once a next chord pointer is marked as not leading to the end chord, it is no longer selected.

Figure 16:
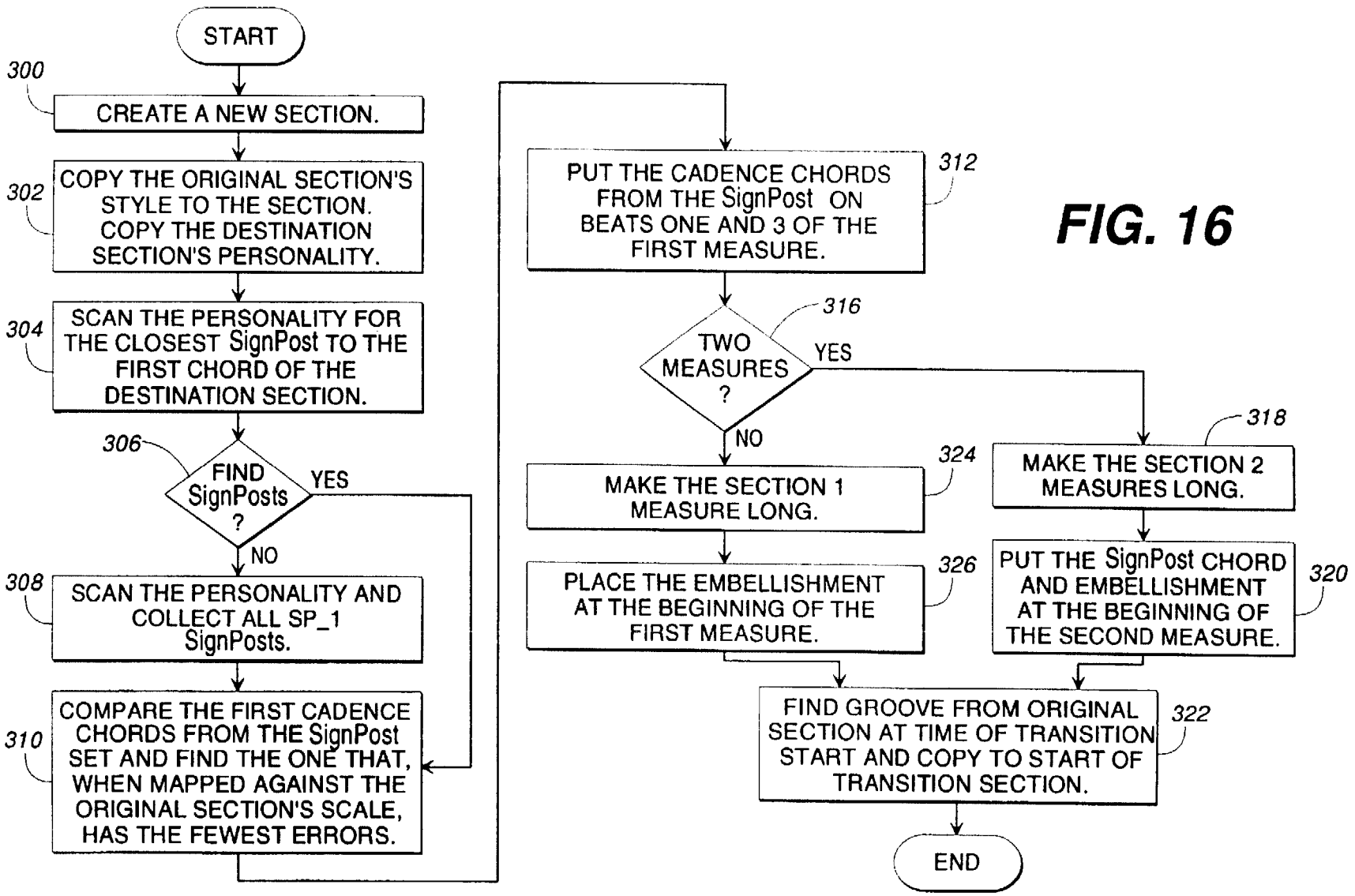
FIG. 16 is a flowchart of a preferred process for music transitional section generator of FIG. 2 which composes a transition section between current and destination music sections.

The preferred process performed by transitional section generator 26 is shown FIG. 16. This process composes a transitional music section for transitioning a performance from a current music section to a destination music section. The transitional section is composed by combining the style data for the current section with the personality of the destination section. The process then finds a signpost chord from the personality that most closely matches the first chord of the destination section and which has an associated first cadence chord that most closely matches the scale of the current section. The cadence chords for that signpost chord are written to the first measure of the transitional section. If the transitional section is two measures long, the matching signpost chord embellishment commands are placed at the first beat of the second measure. If the transitional section is one measure in length, the embellishment command is placed at the first beat of the measure. Finally, the groove level command in the current section active at the transition time is copied to the first beat of the first measure of the transitional section. The transitional section may then be provided to the performance engine 16 or to arbitrator 12.

In more detail, the preferred process for generating a transitional section is shown in FIG. 16. The process is passed a pointer to the current and destination sections, the time (preferably in measures) where the transition occurs, and a flag indicating whether the transitional section is one or two measures in length.

The process begins by creating a section data structure into which the style data of the current section and the personality of the destination section are copied. (Steps 300, 302). The personality is then scanned for the signpost chord closest to the first chord of the destination section (Step 304). Preferably, the term "closest" means a chord having the most notes in common with the notes of the chord in the destination section and the least number of notes that are outside the scale of the current section personality. The cadence chords for this signpost chord are then assigned to the first and middle beats of the first measure of the transitional section. (Step 312).

If the transitional section is a two measure section (Steps 314, 316), the transitional section is made 2 measures long (Step 318) and the signpost chord to which the cadence chords lead is placed at the beginning of the second measure, along with any embellishment commands at the transition point. (Step 320). If the section is one measure in length (Step 324), the embellishment commands are placed at the first beat of the measure. (Step 326). The process then copies the groove level command active in the current section at the time of transition to the transition section. (Step 322).

Figures 17, 18:
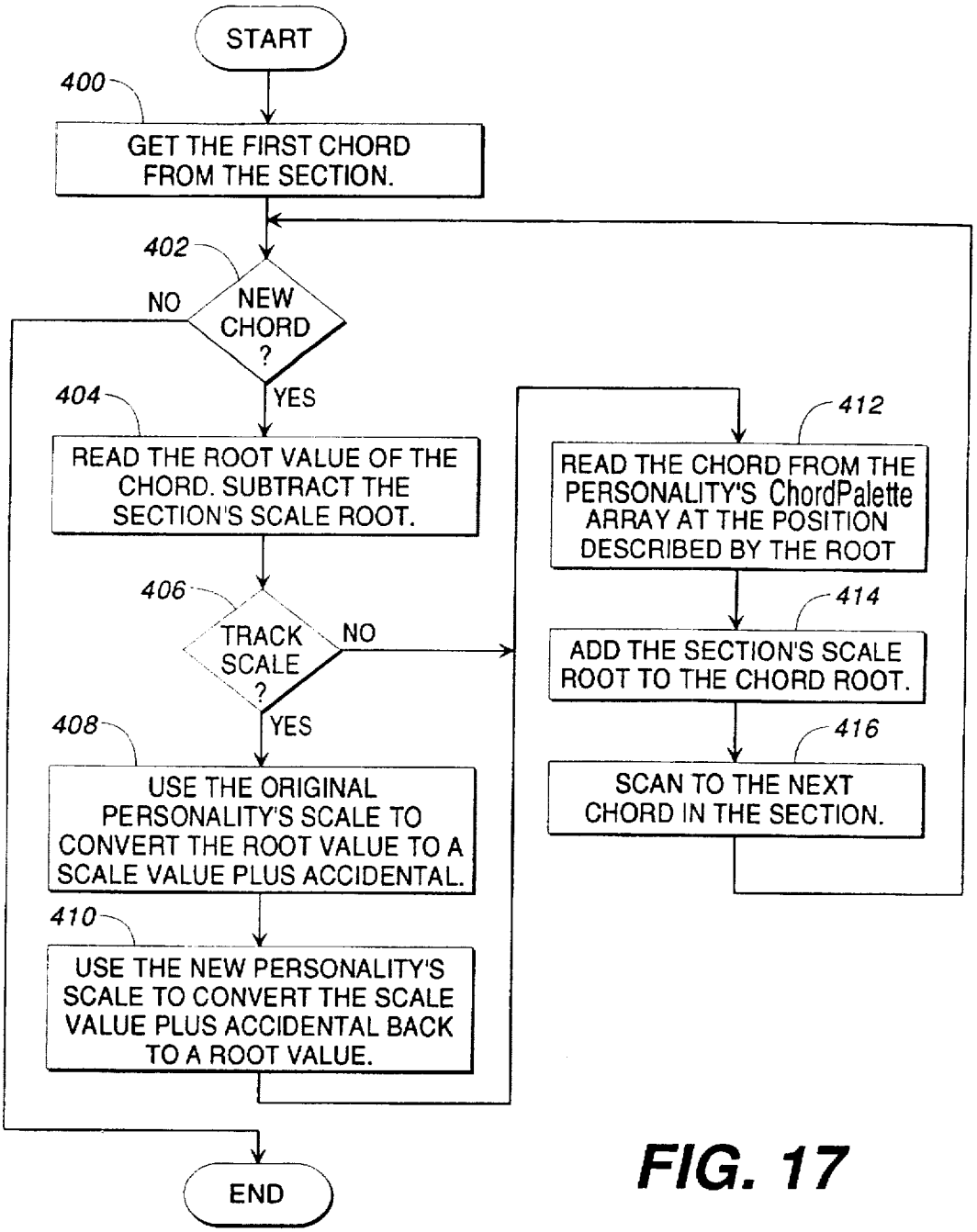
FIG. 17 is a flowchart for a preferred process of musical section personality converter of FIG. 2 which switches the personality of a music section.
FIG. 18 is a preferred data format for representing note data in the system of FIG. 1.

The preferred process for the musical section personality converter 28 which switches the personality of a musical section is shown in FIG. 17. This process updates all the chords of a section to conform to a new personality. The process receives a musical section, a new personality for the section, and a flag that indicates whether the music scale for the personality associated with the music section should be converted to the music scale for the new personality when setting root chord values. The process begins by selecting the first chord in the section to be converted. (Step 400). The chromatic value of the scale root for the personality of the section is subtracted from the chromatic root value of the chord. (Step 404). This subtraction transposes all notes of the section to a common key, preferably C major, for conversion. If the flag for the music scale change is not set, the process reads the chord from the personality chord palette that corresponds to the note of the common key in the preferred two octave range. (Step 412). The chromatic value of the scale root for the section is added to the root of the selected chord (Step 414) and the process continues looking for new chords to convert. (Step 416). If the track scale flag is set, the note of the common key is converted to its diatonic scale value in the original personality scale. (Step 408). That value is then used to select the note that corresponds to that scale value in the new personality scale (Step 410) and the corresponding chord for that note is read from the personality chord palette. (Step 412). The chord is then transposed for the musical section as discussed above. When all the chords have been converted, the section is ready for the performance engine.

An example is helpful in understanding the personality conversion. Preferably, the root notes for chords are defined by a corresponding chromatic value which preferably defines the beginning C of a two octave range as 0 and increments by 1 for each chromatic one half-step up to the value of 25 for the ending C of the range. If the root note is a B for a G major scale in the first octave of the section to be converted, then the corresponding chromatic values are 11 for the root note and 7 for the scale root. The difference defines the chromatic value for the note in the common key which is 4 or E in the C major key. If no scale change is to take place, the chord having E as its root note is selected from the chord palette and all the notes of the chord are transposed to the key of the section by adding the scale root back which in the example is 7. Thus, the process converts the root notes of a musical section to the common C major key which is preferably used for all chord palettes so a chord that corresponds to the new personality may be selected and then transposed to key for the musical section.

When the personality has a new key, then the root note in the common key must be transposed to the new key. In the example above, the E or 4 chromatic value corresponds to the third in the common C major key. Suppose the key for the new personality is a minor key. First, the process selects the third of C minor which is E♭ and selects the corresponding chord from the chord palette. The chord is then transposed to the new key by adding the chromatic value for the section scale root note, which is 7 in the example, to transpose the chord to a root of B♭ which is the minor third of the G key. Thus, the process has selected a chord with its root in the minor third to replace the chord with its root on the major third. This modification alters the chord progression of the musical section prior to conversion to conform to the new personality.

To generate a music sequence for a musical device, the performance generator preferably uses a style and a musical section. A style preferably includes at least identification of the note pattern for each instrument voice that may be performed by the device. The notes comprising a note pattern are transposed by performance engine 16 according to the chord progression defined by the musical section. Because the composition engine 14 of the present invention composes chord progressions for a musical section using random selection and weighted probabilities, the chord progressions vary from performance to performance and the corresponding transposition of the notes and resulting music sequence also varies.

A preferred data format for the representation of notes within a style are shown in FIG. 18. This data format includes four data fields, preferably used to define the notes. The first data field defines an octave in which the note is located. The second data field identifies the position of the note within a chord. Preferably, this field may have the values 0 through 3 which preferably represent the first three notes of a chord triad and the seventh note of a chord. Thus, these numbers identify the root, third, fifth, and seventh of a octave. The third data field identifies the scale position of the note above the chord position. For example, notes of a C7 chord, C, E, G and B, would be represented by the numbers 1, 2, 3, 4 in the second data field, respectively, and the number 0 in the third data field. If the chord being performed in the instrument voice of a style is comprised of the notes, C, F, B♭, the value for the C note would remain the same as the example just discussed. However, the F note would be represented by a 2 in the second data field and a 1 in the third data field, which represents the next scale note in the C major scale above the third of the C major chord. The B♭ note would be defined by a 3 in the second data field, a 1 in the third data field, and a 1 in the fourth data field. The fourth data field represents a half-step out of the scale which preferably is a half-step up, although a note representing scheme in which fourth data field represents a half-step down may also be used.

The performance engine 16 uses the data values of the notes within a note pattern and the chord progression of a musical section to define a music sequence. For example, if the notes C and F in a note pattern are defined as set forth above and a chord in a chord progression defined by a musical section is E major, the performance engine 16 interprets the second data field for the first note, C, as being an E (first note in the triad on the chord root) with no adjustment made for the scale position or for the half step adjustment fields. For the F, the performance engine correlates the F note position within the chord (the second chord note position) to be a G♯ and the 1 scale position value to represent an A. Thus, the performance engine generates music sequence data that causes a musical instrument for the identified instrument voice to play an E and an A, even though the predetermined note pattern defined a C and F. As a result, the chord progressions composed by the composition engine 14 cause the performance generated by performance engine 16 to vary.

Preferably, the style data includes a plurality of variations for the note pattern to be played for a particular instrument voice. These variations further enhance the combinations that may be available to alter the performance of a musical section. More specifically, this type of style structure may be used to implement a motif and a number of variations for that motif. When the motif is performed during the performance of a musical section, the notes of the motif are simply transposed as discussed above for the chord progression defined within the musical section. In this manner, the motif may be varied not only by the predetermined variations within the motif, but by the chord progressions composed by the composition engine in response to the user's input supplied through the application program.

Figure 19:
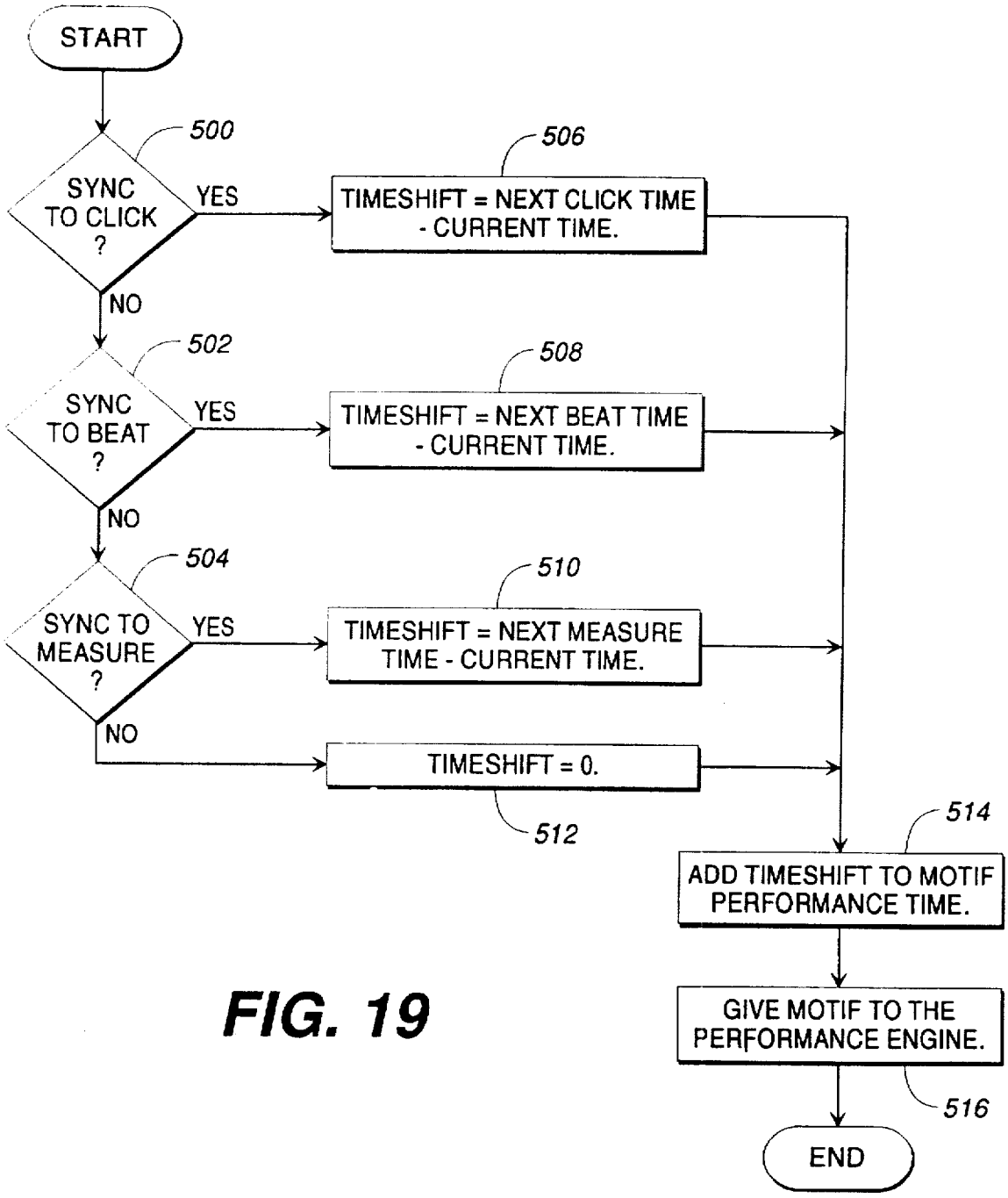
FIG. 19 is a flowchart for a preferred process used to synchronize the performance of a motif to a music section.

The process used by the performance engine to perform a motif is shown in FIG. 19. This process synchronizes the performance of a motif to the current section performance. The process begins by determining whether the performance of the motif should be synchronized to the next unit of time, the next musical beat, or the beginning of the next measure. (Steps 500–504). If any of those synchronization constraints are required, a timeshift calculation as indicated in the figure is made to define the time at which the motif should begin. (Steps 506–510). The calculated timeshift is added to the motif performance time. (Step 514). If there is no need for synchronization, no time shift is added to the motif performance time. (Step 512). The motif pattern and performance time are then provided to the performance engine for generation of the music sequence.

Figure 20:
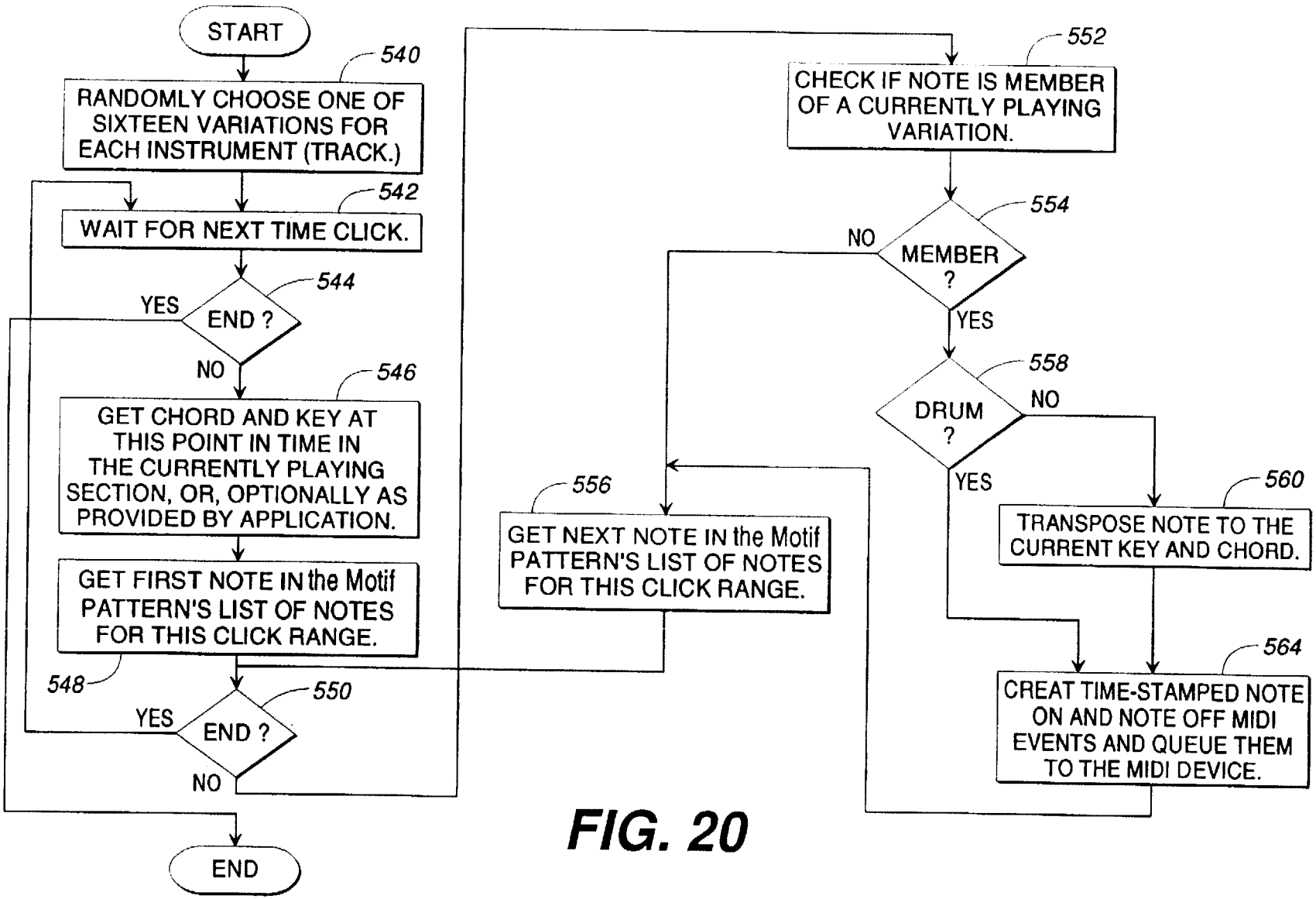
FIG. 20 is a flowchart for a preferred process for performing a motif by the performance engine shown in FIG. 1.

The preferred process for executing a motif within the performance generator is shown in FIG. 20. That process begins by randomly selecting one of the plurality of note pattern variations which defines the notes for an instrument voice within a style. (Step 540). The process then waits for a click of time. (Step 542). A click of time is defined as being the smallest unit of music time resolution which is preferably an eighth note or eighth note triplet in duration. After determining whether the end of a motif has been reached (Step 544), the chord and key for the musical section currently being performed are determined. (Step 546). Alternatively, the chord and key may be provided by arbitrator 12. The process continues by selecting the first note of the pattern for the motif within the current click. (Step 548). The process then determines whether the note selected is within the pattern currently being performed for the instrument voice (Steps 552, 554) and if it is, transposes the note to the current key and chord for the music section (Step 560), if the note is not a drum part (Step 558), in the manner discussed above. The transposed note is then translated to musical device sequence data such as MIDI events (Step 564), which are well known within the art. Once all the notes within the current click have been transposed and converted to sequence data (Step 550), the process continues by incrementing the time click and determining whether the last click has been evaluated. (Step 544). If it has, the process terminates. Otherwise, the process continues until all notes of the motif within the variation being played for a musical voice have been transposed and converted.

In use, a user begins the execution of an application program which results in a multimedia presentation. The application program typically identifies a musical section for an initial scene that is visually presented to the user and the arbitrator 12 provides the section and style to the performance engine 16 to commence performance of musical data.

As the user interacts with the application program through an input mechanism, an event may occur which signals a change in the music to be performed. In response to that interaction, the application program may request the composition of a musical section that conforms to the user's interaction by identifying a style, shape, and personality for the requested music. In response to this request, composition engine 14 may generate a template and then use that template to compose a music section. Alternatively, arbitrator 12 may provide a template corresponding to the request from the application program and provide that template to the composition engine 14 for composition of a musical section. After the musical section has been generated in accordance with the processes described above, the musical section may be provided to the performance engine 16 directly or indirectly through the arbitrator. Arbitrator 12 also supplies a style to performance engine 16 so it may convert the musical section to music sequence data which is supplied to a musical device through instrument interface 20.

Arbitrator 12 may also generate a request to generate a musical transition section or to change the personality of a current musical section in response to a user's interaction. The generation of the music transitional section and the conversion of a musical section to a new personality is performed in accordance with the processes discussed above. The music transitional section or the section converted to the new personality may be supplied directly to the performance engine 16 indirectly or through arbitrator 12.

Arbitrator 12 may receive a command from the application program to play a motif associated with some action that the user has initiated through the input device. In response to this, arbitrator 12 supplies a motif note pattern to the performance engine 16. Performance engine 16 then synchronizes the performance of the motif and transposes it to the currently performed music section to augment the ongoing music performance. These processes may continue until the user terminates interaction with the multimedia program.

While the present invention has been illustrated by the description of preferred and alternative embodiments and processes, and while the preferred and alternative embodiments and processes have been described in considerable detail, it is not the intention of the applicant to restrict or in any way limit the scope of the appended claims to such detail. Additional advantages and modifications will readily appear to those skilled in the art. The invention in its broadest aspects is therefore not limited to the specific details, preferred embodiment, and illustrative examples shown and described. Accordingly, departures may be made from such details without departing from the spirit or scope of applicant's general inventive concept.

What is claimed is:

1. A system for composing music in response to a user's interaction with a multimedia presentation comprising:

an application program interface for receiving parameters identifying a style, a shape, and a personality for music that conform to said user's interaction with said multimedia presentation; and a composition engine for composing a musical section corresponding to said parameters so that a user perceives the performance of the musical section to be related to said user's interaction with said multimedia presentation.

2. The system of claim 1, said composition engine further comprising:

a music transitional section generator for generating a transitional section for transistioning from a current musical section to a destination section.

3. A system for composing music in response to a user's interaction with a multimedia presentation comprising:

an application program interface for receiving parameters identifying music related to said user's interaction with said multimedia presentation; and a composition engine for composing a musical section corresponding to said parameters so that a user perceives the performance of the musical section to be related to said user's interaction with said multimedia presentation, said composition engine comprising a musical template generator for generating a musical template to define a musical shape for said composed musical section.

4. The system of claim 3 wherein said musical template generator selects signpost chord markers from a plurality of signpost chord markers to place within said generated musical template.

5. The system of claim 3 wherein said musical template generator randomly selects signpost chord markers from a plurality of signpost chord markers to place within said generated musical template.

6. The system of claim 4 wherein said musical template generator places said selected signpost chord markers within said generated musical template.

7. The system of claim 6 wherein said musical template generator randomly selects a duration for said signpost chord markers placed within said generated musical template.

8. The system of claim 3 wherein said musical template generator places embellishment commands in said generated musical template.

9. The system of claim 3 wherein said musical template generator places groove level commands in said generated musical template.

10. The system of claim 9 wherein said musical template generator randomly places embellishment commands in said generated musical template in correspondence with said groove level commands placed within said musical template.

11. The system of claim 10 wherein said musical template generator places one of a fill and a break embellishment command in correspondence with said groove level commands placed within said musical template.

12. The system of claim 9 wherein said musical template generator generates said groove level commands from a starting and an ending groove level commands.

13. A system for composing music in response to a user's interaction with a multimedia presentation comprising:

an application program interface for receiving parameters identifying music related to said user's interaction with said multimedia presentation; and a composition engine for composing a musical section corresponding to said parameters so that a user perceives the performance of the musical section to be related to said user's interaction with said multimedia presentation, said composition engine comprising a musical section generator for generating said musical section from a musical template and a personality, said musical template defining a musical shape for said musical section and said personality defining musical chord data for said musical section.

14. The system of claim 13, wherein said musical section generator selects signpost chords to place in said musical section from a signpost chord list in said personality.

15. The system of claim 14 wherein said musical section generator places said selected signpost chords in said musical section in correspondence with signpost chord markers in said template.

16. The system of claim 13 wherein said musical section generator selects groove level commands from said musical template to place in said musical section.

17. The system of claim 13 wherein said musical section generator selects embellishments commands from said musical template to place in said musical section.

18. The system of claim 13 wherein said musical section generator generates a chord progression for said musical section from a chord entry list in said personality.

19. The system of claim 13 wherein said musical section generator generates a chord progression for said musical section from a chord entry list and a signpost chord list in said personality.

20. The system of claim 13 wherein said musical section generator generates a chord progression for said musical section from said signpost chord markers in said musical template and a chord entry list and a signpost chord list in said personality.

21. The system of claim 13 wherein said musical section generator selects next chord pointers to select said chords for said chord progression.

22. The system of claim 21 wherein musical section recursively walks a path defined by said next chord pointers to select said chords for said chord progression.

23. A system for composing music in response to a user's interaction with a multimedia presentation comprising:

an application program interface for receiving parameters identifying music related to said user's interaction with said multimedia presentation;

a composition engine for composing a musical section corresponding to said parameters so that a user perceives the performance of the musical section to be related to said user's interaction with said multimedia presentation; and a music transitional section generator for generating a transitional section for transitioning from a current musical section to a destination section, wherein said music transitional section generator selects a first signpost chord from a personality associated with said destination musical section which corresponds to a chord of the destination section and which has an associated first cadence chord that corresponds to a scale of the current section.

24. A system for composing music in response to a user's interaction with a multimedia presentation comprising:

an application program interface for receiving parameters identifying music related to said user's interaction with said multimedia presentation;

a composition engine for composing a musical section corresponding to said parameters so that a user perceives the performance of the musical section to be related to said user's interaction with said multimedia presentation; and a musical section personality converter for changing a chord progression of a current musical section to correspond to another personality.

25. The system of claim 24, wherein said musical section personality converter selects a chord from a chord palette in said personality which corresponds to a root note of a chord selected from said current musical section and transposes said selected chord palette chord to correspond to said root note of said chord from said current musical section.

26. The system of claim 25 wherein said musical section personality converter transposes said root of said selected chord from said current musical section to a key associated with said another personality.

27. A system for composing music in response to a user's interaction with a multimedia presentation comprising:

an application program interface for receiving parameters identifying music related to said user's interaction with said multimedia presentation;

a composition engine for composing a musical section corresponding to said parameters so that a user perceives the performance of the musical section to be related to said user's interaction with said multimedia presentation; and a performance engine that performs a motif in accordance to a style and a musical section.

28. The system of claim 27 wherein said performance engine transposes notes in a note pattern of said motif to correspond to a key and chord of said musical section.

29. A system for composing music in response to a user's interaction with a multimedia presentation comprising:

an application program interface for receiving parameters identifying music related to said user's interaction with said multimedia presentation;

a composition engine for composing a musical section corresponding to said parameters so that a user perceives the performance of the musical section to be related to said user's interaction with said multimedia presentation; and a performance engine for generating music sequence data from said musical section and a style, said music sequence data being transmitted to a musical device coupled to said performance engine through an instrument interface.

30. The system of claim 29 wherein said instrument interface is a MIDI.

31. A process for varying the musical accompaniment of a multimedia presentation so the accompaniment varies in response to a user's interaction, comprising the step of:

composing a musical section in response to parameters received from an application program driving the multimedia presentation, said parameters identifying a style, a shape, and a personality for said musical accompaniment, said composed musical section being performed by a performance engine in response to said user's interaction with the multimedia presentation.

32. The process of claim 31, further comprising the step of:

composing a transitional section to transition a performance from a current musical section to a destination musical section.

33. A process for varying the musical accompaniment of a multimedia presentation so the accompaniment varies in response to a user's interaction comprising the steps of:

composing a musical section in response to parameters received from an application program driving the multimedia presentation, said composed musical section being performed by a performance engine in response to said user's interaction with the multimedia presentation; and composing a chord progression to place in said composed musical section.

34. The process of claim 33 further comprising the steps of:

selecting chords to define a template for said chord progression; and connecting chords between said selected chords to form said composed chord progression.

35. The process of claim 34, wherein said step of selecting chords to define a template for said chord progression comprises selecting chords from a set of signpost chords, and wherein said step of connecting chords between said selected chords comprises selecting said connecting chords from a list of chord entries.

36. The process of claim 35, wherein said step of connecting chords further comprises recursively walking a path of connecting chords by using next chord pointers.

37. The process of claim 36, wherein said step of walking a path comprises using weighted probabilities associated with said next chord pointers to recursively walk said path of connecting chords.

38. The process of claim 33 further comprising the step of placing embellishment commands in said composed musical section.

39. The process of claim 33 further comprising the step of placing groove level commands in said composed musical section.

40. The process of claim 39 wherein said step of placing groove level commands comprises ordering said groove level commands in correspondence with a musical template shape.

41. A process for varying the musical accompaniment of a multimedia presentation so the accompaniment varies in response to a user's interaction, comprising the steps of:

composing a musical section in response to parameters received from an application program driving the multimedia presentation, said composed musical section being performed by a performance engine in response to said user's interaction with the multimedia presentation; and converting a personality of a current musical section to another personality.

42. A process for varying the musical accompaniment of a multimedia presentation so the accompaniment varies in response to a user's interaction, comprising the steps of:

composing a musical section in response to parameters received from an application program driving the multimedia presentation, said composed musical section being performed by a performance engine in response to said user's interaction with the multimedia presentation; and performing a motif in accordance with said composed musical section.

43. A composition engine for composing chord progressions comprising:

an arbitrator for receiving parameters for composing a musical section and retrieving a musical template in response to said parameters, said parameters comprising a personality; and a musical section generator for generating said musical section from said musical template and said personality received from said arbitrator.

44. The composition engine of claim 23, wherein said musical section generator generates a chord progression from signpost chords corresponding to said personality.

45. A computer readable medium on which is stored a computer program for varying the musical accompaniment of a multimedia presentation so the accompaniment varies in response to a user's interaction, said computer program comprising instructions which, when executed by a computer, perform the step of:

composing a musical section in response to parameters received from an application program driving the multimedia presentation, said parameters identifying a style, a shape, and a personality for said musical accompaniment, said composed musical section being performed by a performance engine in response to said user's interaction with the multimedia presentation.

46. The computer-readable medium recited in claim 45, further comprising the step of:

composing a chord progression to place in said composed musical section.

47. The computer-readable medium recited in claim 45, further comprising the steps of:

composing a chord progression to place in said composed musical section;

selecting chords to define a template for said chord progression; and connecting chords between said selected chords to form said composed chord progression.

* * * * *

UNITED STATES PATENT AND TRADEMARK OFFICE

CERTIFICATE OF CORRECTION

PATENT NO. : 5,753,843

DATED : May 19, 1998

INVENTOR(S) : C. TODOR FAY

It is certified that error appears in the above-identified patent and that said Letters Patent is hereby corrected as shown below:

In column 17, line 55, claim 1, after "that", please delete [conform] and insert in place thereof --conforms--

In column 17, line 66, claim 2, please delete [transistioning] and insert in place thereof -- transitioning --

Signed and Sealed this

Twenty-sixth Day of October, 1999

*Attest:*

Q. TODD DICKINSON

*Attesting Officer*

*Acting Commissioner of Patents and Trademarks*